US010315294B2

(12) United States Patent
Rettler

(10) Patent No.: US 10,315,294 B2
(45) Date of Patent: Jun. 11, 2019

(54) INERTIAL SOCKET ADAPTOR FOR TORQUE APPLICATION TOOLS

(71) Applicant: SNAP-ON INCORPORATED, Kenosha, WI (US)

(72) Inventor: Jim T. Rettler, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 15/590,558

(22) Filed: May 9, 2017

(65) Prior Publication Data

US 2018/0326564 A1 Nov. 15, 2018

(51) Int. Cl.

| | |
|---|---|
| ***B25B 21/02*** | (2006.01) |
| ***B25B 23/00*** | (2006.01) |
| ***B25B 21/00*** | (2006.01) |
| ***B25B 23/147*** | (2006.01) |
| *B25B 13/00* | (2006.01) |

(52) U.S. Cl.
CPC ..... *B25B 23/0035* (2013.01); *B25B 21/007* (2013.01); *B25B 23/1475* (2013.01); *B25B 13/00* (2013.01); *B25B 21/02* (2013.01)

(58) Field of Classification Search
CPC ..... B25B 23/0035; B25B 21/007; B25B 23/1475; B25B 13/00
See application file for complete search history.

(56) References Cited

U.S. PATENT DOCUMENTS 2,987,334 A 6/1961 Wendling
4,157,120 A * 6/1979 Anderson ..... B25B 19/00 173/93
D319,562 S 9/1991 Ballard
5,361,656 A * 11/1994 Starr ..... B25B 23/00 81/177.85
5,405,221 A 4/1995 Ducker, III et al.
D361,485 S 8/1995 Seltz
5,568,757 A 10/1996 Lewis
5,595,099 A 1/1997 Pusateri
D397,598 S 9/1998 Falk
(Continued)

FOREIGN PATENT DOCUMENTS

TW 398375 7/2000
TW M249763 11/2004
(Continued)

OTHER PUBLICATIONS

UK Combined Search and Examination Report for Application No. GB1803661.6, dated Aug. 28, 2018, 6 pages.
(Continued)

*Primary Examiner* — Sunil K Singh
*Assistant Examiner* — Paul M Janeski
(74) *Attorney, Agent, or Firm* — Seyfarth Shaw LLP

(57) ABSTRACT

A socket adapter that increases the transfer of impacting torque forces from a torque application tool to a conventional fastener engaged by a socket. The socket adapter includes a body with a female end that is adapted to removably couple to the tool, and male end that is adapted to removable couple to a conventional socket. Ribs radiate outwardly from the body between the male and female ends. The ribs couple a mass ring to the body to provide for increased rotational inertia of the socket adapter.

18 Claims, 5 Drawing Sheets

(56) References Cited

U.S. PATENT DOCUMENTS

| | | | | |
|---|---|---|---|---|
| 6,176,160 | B1 | 1/2001 | Ruhlander et al. | |
| 6,321,855 | B1 | 11/2001 | Barnes | |
| 6,604,441 | B2 | 8/2003 | Lin | |
| D562,657 | S | 2/2008 | Hsieh | |
| 8,342,061 | B2 | 1/2013 | Super | |
| D685,237 | S | 7/2013 | Super | |
| 9,463,557 | B2 | 10/2016 | Seith et al. | |
| 9,469,017 | B2 | 10/2016 | Seith et al. | |
| 2010/0326249 | A1 | 12/2010 | Super | |
| 2012/0255749 | A1 | 10/2012 | Seith et al. | |
| 2015/0217431 | A1* | 8/2015 | Seith | B25B 13/06 81/121.1 |
| 2015/0217433 | A1 | 8/2015 | Seith et al. | |
| 2017/0028537 | A1 | 2/2017 | McClung et al. | |

FOREIGN PATENT DOCUMENTS

| | | |
|---|---|---|
| TW | 201221316 | 6/2012 |
| TW | M525821 | 7/2016 |
| TW | 201714716 | 5/2017 |
| WO | 2012138721 | 10/2012 |

OTHER PUBLICATIONS

Taiwan Office Action for Application No. 107115526, dated Dec. 20, 2018, 14 pages.
Australian Examination Report No. 1 for Application No. 2018201134 dated Jan. 16, 2019, 3 pages.

* cited by examiner

INERTIAL SOCKET ADAPTOR FOR TORQUE APPLICATION TOOLS

TECHNICAL FIELD OF THE INVENTION

A socket adapter for use with torque application tools that increases the torque delivered by the tool to the head of a fastener.

BACKGROUND OF THE INVENTION

Torque is rotational force, and represents a rate of change of angular momentum of an object. In the International System (SI), torque is measured in newton-meters (N·m), and angular momentum is measured in newton-meters-seconds (N·m·s). Angular momentum is proportional to the rotational inertia of the object times its angular speed. The angular momentum of a system remains constant, unless acted on by an external torque. The change to the angular momentum due to application of torque is called angular impulse (also N·m·s). For example, an object that is not rotating can be accelerated to a spin having an angular momentum of "x" N·m·s by application of a torque of "x" N·m for one second, equivalent to applying an angular impulse of "x" N·m·s.

"High-torque" application tools abruptly apply a large peak torque to an output shaft, resulting in rotational force jumping near-instantaneously from zero to a large value. Plotted against time, each application of torque would graphically appear to be a "spike," jumping from no torque to a large peak and then returning to no torque. Since the tool possesses rotational inertia, this quick spike of force reduces the exertion required by the user holding the tool, relative to the resistance the user needs to provide if the force was sustained continuously over a longer period of time.

Two common types of high-torque application tools are impact drivers and pulse torque tools. An impact driver (commonly referred to as an impact gun) is designed to deliver high torque output by storing energy in a rotating mass (e.g., the hammer), which is impacted to suddenly connect the rotating mass to an output shaft (e.g., the anvil). After delivering the impacting force, the hammer again spins freely from the anvil. Pulse torque tools use oil or other hydraulic fluid with a clutch to transfer kinetic energy from the hammer into the anvil to produce torque. By repeatedly applying the impacting torque to the hammer, impact drivers and pulse torque tools produce a series of impacting force-pulses over time, with torque returning to zero between each spike of force.

SUMMARY OF THE INVENTION

The invention broadly comprises a socket adapter that includes a cylindrical body, a male drive lug, which is adapted to be coupled to common torque application extensions (e.g., sockets) extending from a first end of the cylindrical body, and a female receptacle connector in a second end of the cylindrical body, which is adapted to be coupled to common torque application lugs (e.g., impact gun lug) that is opposite the first end. Ribs radiate outwardly from the cylindrical body. A solid ring with an inner diameter larger than an outer diameter of the cylindrical body is fixedly coupled to the cylindrical body by the ribs. There are openings circumferentially around the cylindrical body, with one opening between each pair of adjacent ribs.

The socket adapter may be also be arranged in a kit that include differently sized, yet conventional sockets to engage fasteners with different head sizes. The socket adapter may also be arranged in a system. As a system, a drive shaft of a torque tool is removably coupled to the female receptacle of the socket adapter. The torque tool applies rotational force to the drive shaft to create torque. A socket, such as a conventional hexagonal socket, is removably coupled to the male drive lug of the socket adapter. The socket engages a fastener to transfer torque from the torque tool to the fastener.

BRIEF DESCRIPTION OF DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
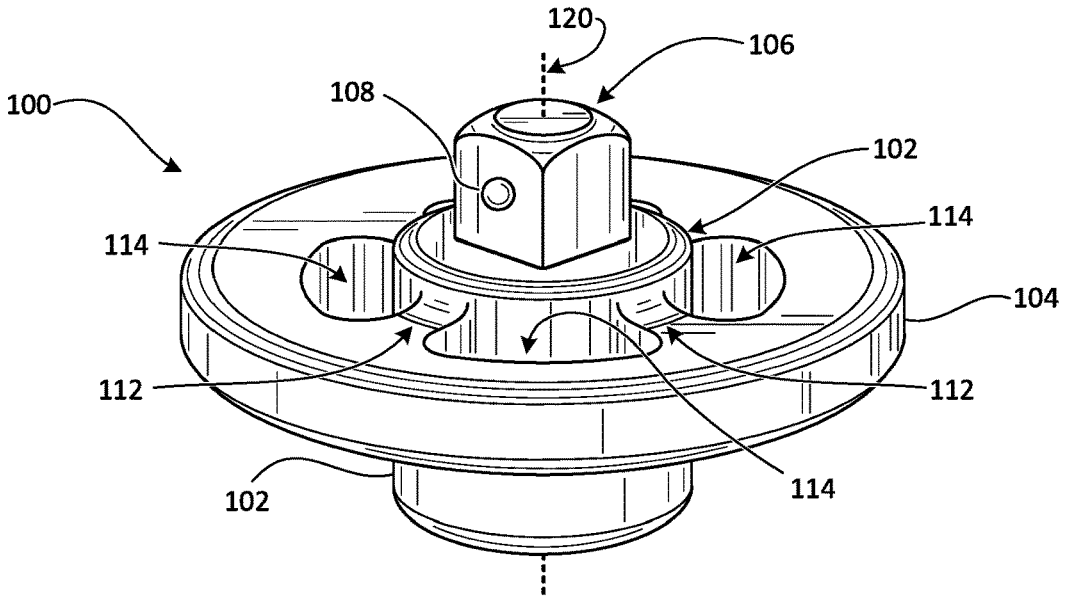
FIG. 1 is a perspective view of a male end of an embodiment of the socket adaptor.
Figure 2:
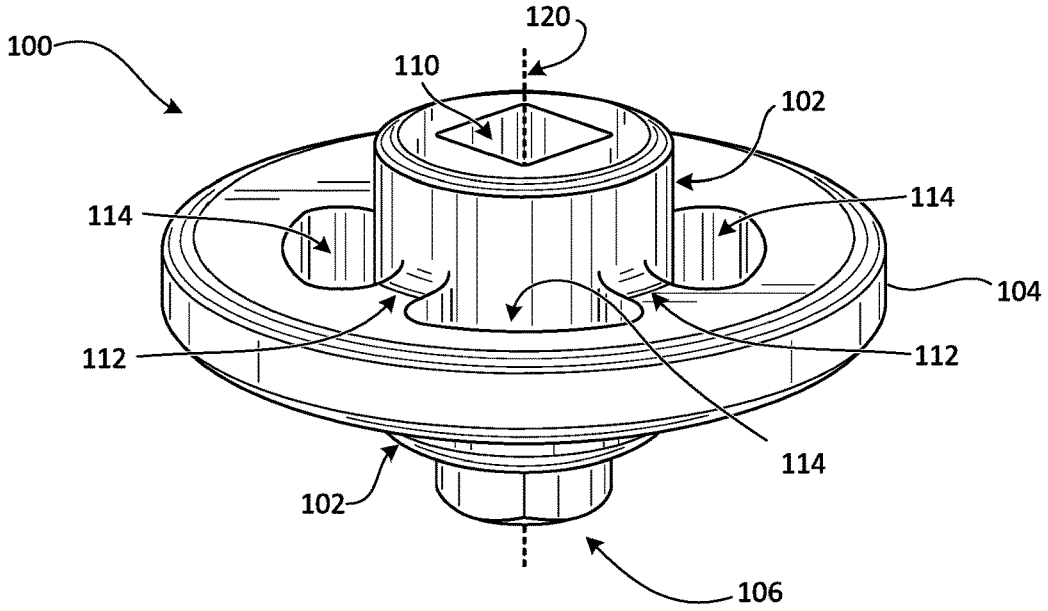
FIG. 2 is a perspective view of a female end of an embodiment of the socket adaptor.
Figure 3:
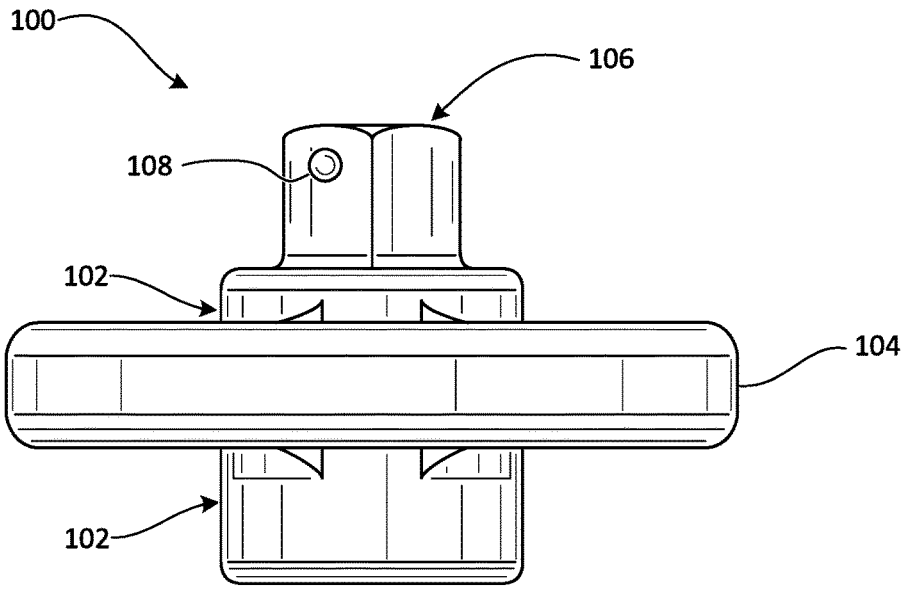
FIG. 3 is a first side view of an embodiment of the socket adaptor.
Figure 4:
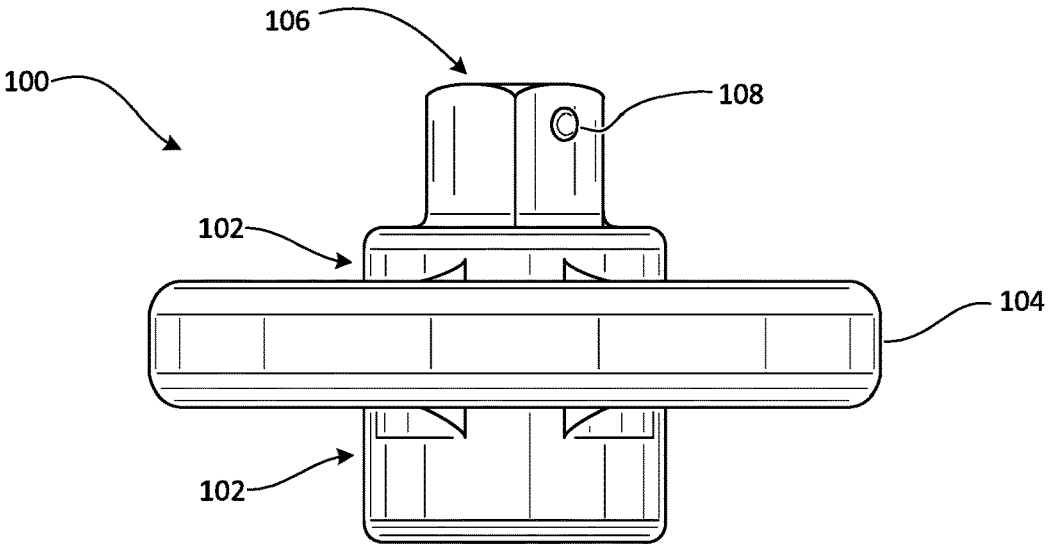
FIG. 4 is a second side view of an embodiment of the socket adaptor.
Figure 5:
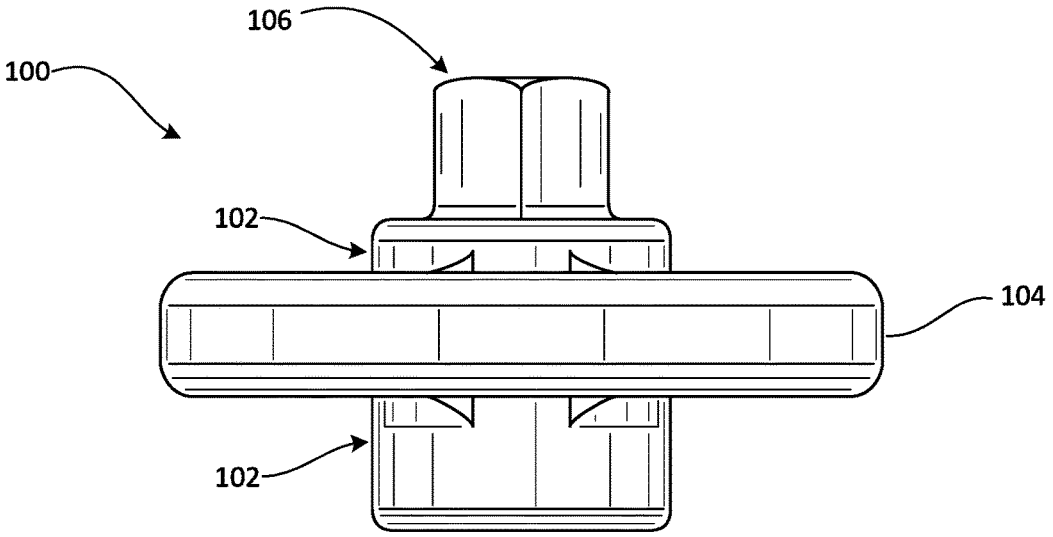
FIG. 5 is a third side view of an embodiment of the socket adaptor.
Figure 6:
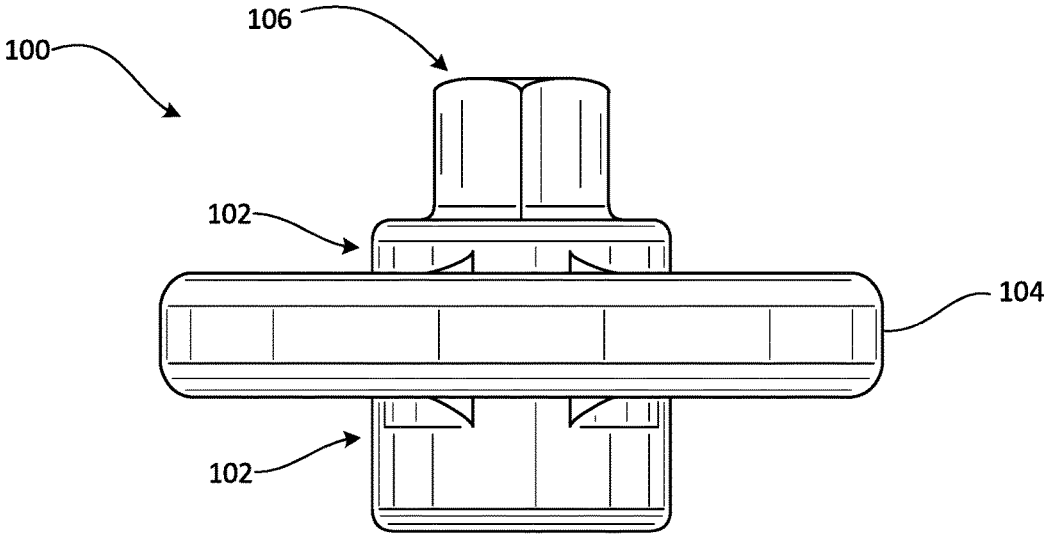
FIG. 6 is a fourth side view of an embodiment of the socket adaptor.
Figure 7:
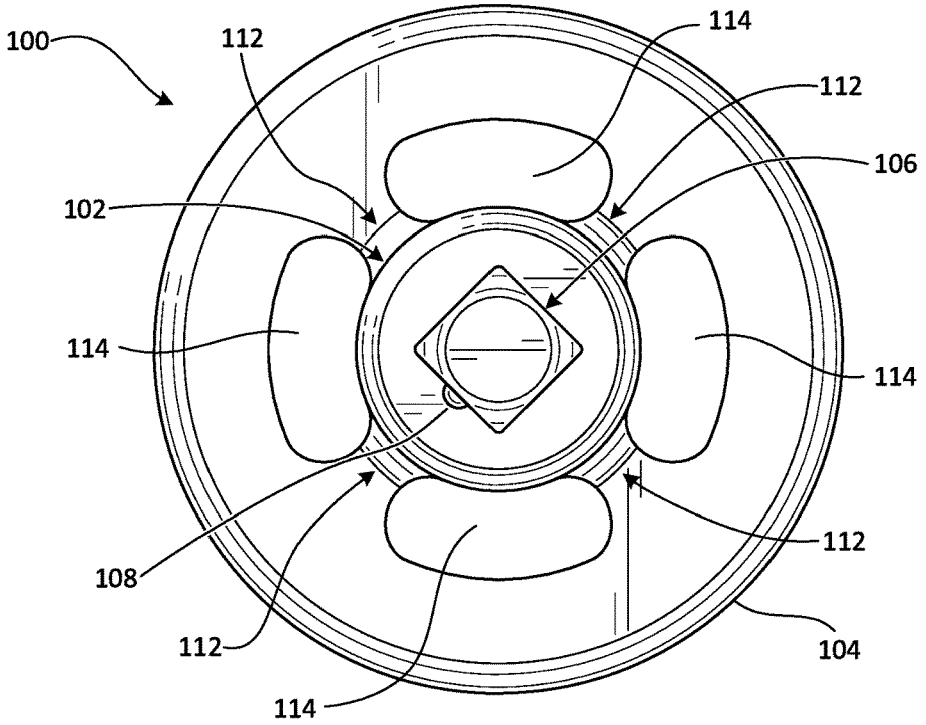
FIG. 7 is a top plan view of an embodiment of the socket adaptor facing the male end.
Figure 8:
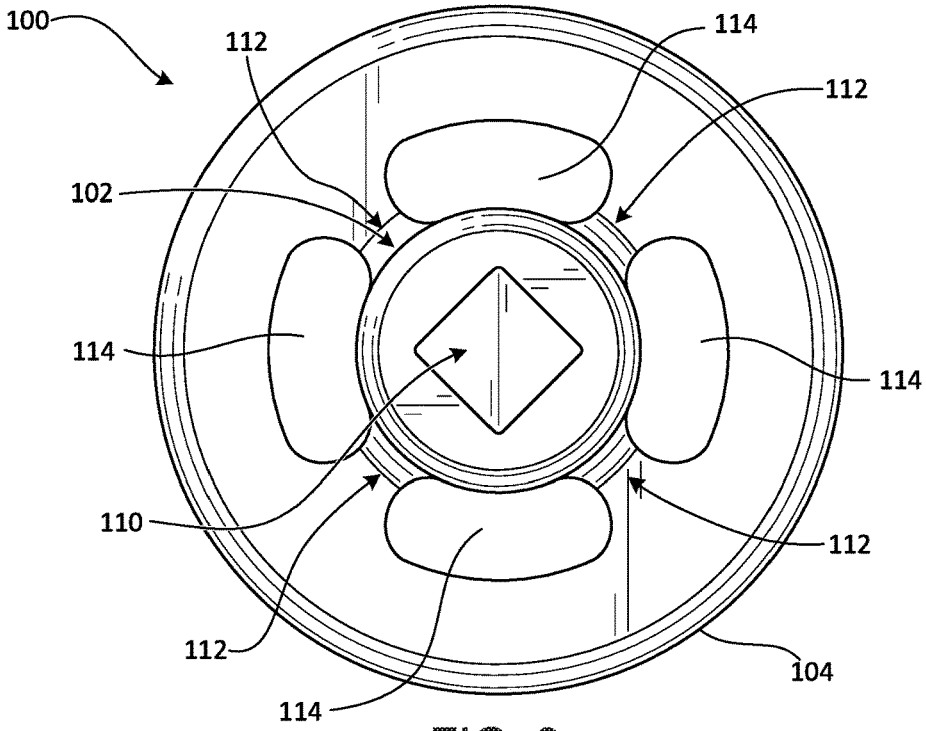
FIG. 8 is a bottom plan view of an embodiment of the socket adaptor facing the female end.

While the present invention is susceptible of embodiments in many different forms, there is shown in the drawings, and will herein be described in detail, embodiments, including a preferred embodiment, of the invention with the understanding that the present disclosure is to be considered as an exemplification of the principles of the invention and is not intended to limit the broad aspect of the invention to any one or more of the embodiments illustrated or disclosed. As used herein, the term "present invention" is not intended to limit the scope of the claimed invention, and is instead a term used to discuss exemplary embodiments of the invention for explanatory purposes only.

When using a high torque tools to remove a fastener, such as a crank bolt, a lug nut or other fasteners, it can be advantageous to apply and increase the removal torque in an impacting fashion from the hammer to the fastener. This can be accomplished by increasing the rotational inertia on the output shaft (e.g., the anvil) of the tool. The rotational inertia of a system is an additive property, based on the sum of the rotational inertia of all of the bodies rotating around a same axis.

In an embodiment, the invention broadly comprises a socket adapter that includes a cylindrical body, a male drive lug extending outwardly from a first end of the cylindrical body, and a female receptacle connector in a second end of the cylindrical body that is opposite the first end. The male drive lug is conventionally sized and shaped to allow for differing sizes of conventional sockets to be selectively coupled to the socket adapter, depending on the size and/or shape of the head of the fastener to be removed. Thus, the adaptability of being coupled to different sizes and/or shapes of sockets allows the socket adapter to be used to remove varying sizes and shapes of fasteners.

The socket adapter also includes ribs that radiate outwardly from the cylindrical body. A solid ring mass with an inner diameter that is larger than an outer diameter of the cylindrical body is fixedly connected to the cylindrical body by the ribs. This solid ring provides additional mass and increases rotational inertial and impacting forces applied by the tool to assist in removing fasteners.

Referring to FIGS. 1 to 8, an adapter 100 couples to a drive end of a conventional torque application tool (e.g., an impact gun) and a conventional connector (e.g., a socket) used to engage a head of a fastener. The adapter 100 has a male lug 106 extending from one end that couples to a connector in a well-known manner, and a female connector (receptacle 110) in the other end that receives a male-drive output shaft of the torque tool in a well-known manner. The lug 106 and the receptacle 110 are each axially symmetric around a central axis 120. When coupled to the drive shaft of a torque application tool and a socket, the adapter 100, the lug 106, and the connector rotate around the shared central axis 120, thereby combining the rotational inertias of the adapter 100, due to the increased mass, the lug 106, and the connector. As a result, the adapter 100 increases the impacting torque forces transferred to the head of a fastener engaged by the connector, thus facilitating insertion and/or removal of the fastener.

The adapter includes a body 102 that is substantially axially-symmetric around the central axis 120 and connected to a ring 104. As illustrated, the body 102 is substantially cylindrical; however, the body may have other geometric shapes while not departing from the spirit and scope of the present invention. The inner and outer diameters of the ring 104, relative to the central axis 120, are larger than the outer diameter of the cylindrical body 102. The larger-diameter ring 104 is a substantially solid mass and is rigidly connected to the cylindrical body 102 by ribs 112. The ribs 112 radiate outwardly from the body 102 and are arranged symmetrically around the body 102, relative to the central axis 120. The ring 104 and ribs 112 are transected by a plane that is substantially orthogonal to the central axis 120, in a plane cutting across the body 102 between the drive 106 and the receptacle 110.

In an embodiment, there are openings (i.e., voids) 114 arranged circumferentially around the body 102 between each adjacent pair of ribs 112 through the plane/disk forming the ring 104. The inner-edge of each opening 114 is the cylindrical body 102, the outer-edge of each opening 114 is the ring 104, and the lateral edges of each opening 114 is a respective rib 112. The openings 114 reduce the overall mass of the adapter 100 relative to the mass that would be required to achieve the same rotational inertial impacting force if the spinning disk was solid, taking advantage of the increased inertial impacting force due to centrifugal force created by positioning the mass of the ring 104 outwardly away from the central axis 120.

The lug 106 of the adapter 100 may include a socket retention detent ball 108, which engages a detent in a socket to removably couple the socket to the adapter 108, in a well-known manner. One or more sidewalls of the receptacle 110 may include a detent to removably secure the adapter 100 to a retention detent ball included in a drive shaft of the torque tool in a well-known manner.

Figure 9:
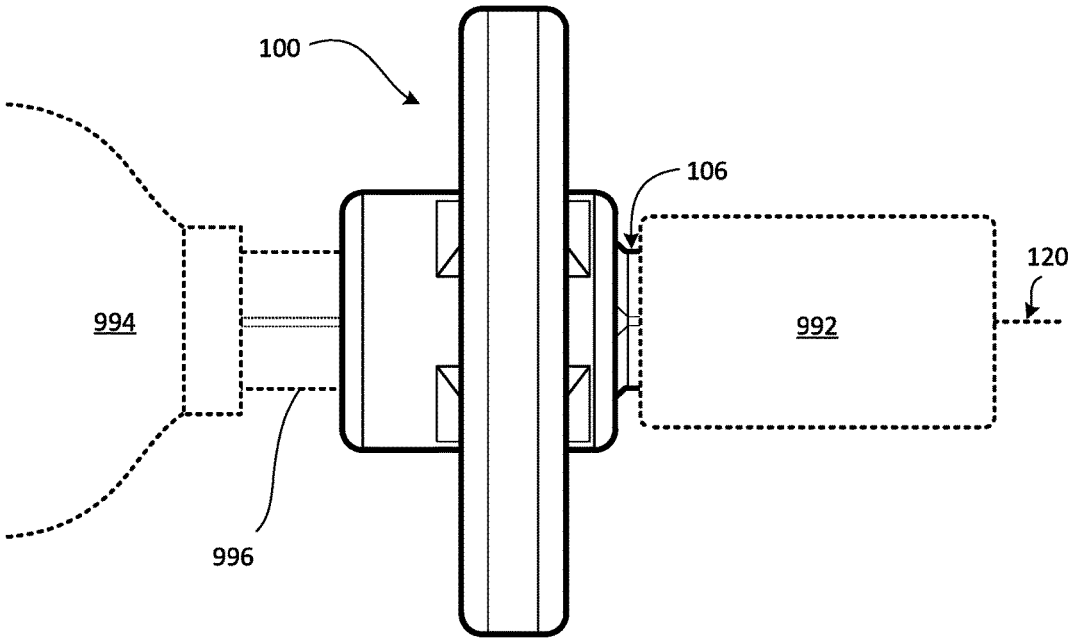
FIG. 9 illustrates an embodiment of the socket adapter configured between a typical impact gun and a typical socket.

Referring to FIG. 9, an embodiment of the adapter 100 can be removably coupled between an impact gun 994 and a socket 992. The receptacle 110 of the adapter 100 receives the male drive of the shaft 996 of the impact gun 994. The lug 106 of the adapter 100 is inserted into the receptacle of a socket 992, in a well-known manner. The ring 104 increases the torque transferred to the head of a fastener coupled to the socket 992 (not illustrated), as the drive shaft 996, adapter 100, and socket 992 rotate around central axis 120.

The adapter 100 may be removably coupled to a variety of different, yet conventional, sockets, including different sockets designed to engage fasteners with different head sizes. For example, the sockets may be SAE or metric hexagonal sockets, each having different hexagonal cross-sectional dimensions that are adapted to engage differently sized heads of fasteners.

It will be understood that although an impact gun 994 is shown in FIG. 9 for illustrative purposes, the adapter 100 may be mounted on any type of torque application tool. In an embodiment, to further increase rotational inertia, a first adapter 100 can be removably coupled to a second adapter 100 (e.g., the lug of the first adapter and be engaged with the connector of the second adapter), with the combined first and second adapters combining to create an increased mass to increase impacting inertial forces and being removably coupled between the torque tool and a socket.

In an embodiment, the cylindrical body 102, ribs 112, and ring 104 may be a monolithic structure formed from a metal such as a steel or steel alloy. In another embodiment, to further increase rotational inertia relative to the overall mass of the adapter 100, some or all of the ring 104 may comprise a higher density material than that of the body 102. For example, at least an outer periphery of the ring 104 may comprise a tungsten alloy, whereas the body 102 and ribs 112 may comprise chromium-vanadium steel. The ring 104 may be a composite structure of higher-density and lower-density structures. For example, a larger-diameter, higher-density section of the ring 104 may be bonded or otherwise coupled to an outer periphery of a smaller-diameter, lower-density section of the ring 104, with the ribs 112 fixedly coupled to the lower-density section.

The lug 106 may have a conventional square cross-section, each side surface being one-half inch, three-eighths inch, or one-quarter inch, as is commonly used to be coupled to conventional sockets, such as SAE and metric hexagonal sockets. The sidewalls of the receptacle 110 have comparable dimensions, to receive the male shaft of a conventional high-torque tools (typically one-half inch or three-eighths inch). The cross-sectional side dimensions of the lug 106 and the receptacle 106 may be comparable/substantially the same (e.g., a one-half inch male drive and a one-half inch female receptacle, with the female receptacle being slightly larger to accommodate insertion of a male drive of the same size), or they may be different (e.g., a three-eighths inch male drive and a one-half inch female receptacle). Since torque is applied via the receptacle-side of the adapter 100, the receptacle 110 preferably has dimensions comparable-to or larger-than the dimensions of the lug 106.

As described, the lug 106 and receptacle 110 each have square cross-section configurations. However, any lug/receptacle cross-sectional shape may be used, such as a polygonal (e.g., hexagonal) or star-pattern (e.g., Torx®) configuration for one or both of the lug 106 and the female receptacle 110. Similarly, the lug/receptacle may have any size adapted to engage a socket/drive shaft of a torque tool.

The specific examples discussed above are meant to be illustrative. They were chosen to explain the principles and application of the disclosure and are not intended to be exhaustive. Persons having ordinary skill in the fields of powered torque tools should recognize, for example, that components described herein may be interchangeable with other components, such as removably coupling a universal joint between the adapter 100 and the socket 992, or a hex-to-screwdriver bit between the socket 992 and a fastener.

As used in this disclosure, the term "a" or "one" may include one or more items unless specifically stated otherwise. Further, the phrase "based on" is intended to mean "based at least in part on" unless specifically stated otherwise.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A socket adapter comprising:

a body having a body density and opposing first and second ends;

a lug extending outwardly from the first end and adapted to engage a recess of a socket;

a female receptacle connector disposed in the second end; and a ring mass having a ring mass density and coupled to the body, and having an inner diameter that is larger than an outer diameter of the body, wherein at least a portion of the ring mass density is greater than the body density.

2. The socket adapter of claim 1, further comprising ribs radiating outwardly from the body between the first and second ends and coupling the ring mass to the body.

3. The socket adapter of claim 2, further comprising a corresponding opening disposed between each pair of adjacent ribs.

4. The socket adapter of claim 2, wherein the body, the ribs, and the ring mass are a monolithic structure.

5. The socket adapter of claim 1, wherein the lug and the female receptacle connector each has a substantially square cross-section.

6. The socket adapter of claim 1, wherein the lug and the female receptacle connector have respectively different cross-sectional dimensions.

7. A kit comprising: a socket adapter including: a body comprised of a body material having a body material density, wherein the body includes opposing first and second ends; a lug extending from the first end and adapted to engage a recess of a socket; a female receptacle connector disposed in the second end, wherein the female receptacle connector is adapted to couple to a drive shaft of a torque application tool; and a ring mass coupled to the body and having an inner diameter that is larger than an outer diameter of the body; and a first socket having a first socket having a first socket end adapted to removably couple to the lug, and a second socket end adapted to engage a head of a first fastener having a first head size, wherein at least a portion of the ring mass has a density that is greater than the body material density.

8. The kit of claim 7, wherein the socket adapter further includes ribs radiating outwardly from the body between the first and second ends and coupling the ring mass to the body.

9. The kit of claim 8, wherein the socket adapter further includes a corresponding opening disposed between each pair of adjacent ribs.

10. The kit of claim 9, wherein the body, the ribs, and the ring mass are a monolithic structure.

11. The kit of claim 7, further comprising a second socket adapted to removably couple to the lug, and adapted to engage a second fastener that has a second head size different than the first head size.

12. The kit of claim 7, wherein the lug and the female receptacle connector each has a substantially square cross-section.

13. The kit of claim 7, wherein the lug and the female receptacle connector have different cross-sectional dimensions.

14. A system comprising: a torque tool having a drive shaft and adapted to apply rotational force to the drive shaft to create torque; a socket adapter having: a body comprised of a body material having a body material density, wherein the body includes opposing first and second ends; a lug extending from the first end and adapted to engage a recess of a socket; a female receptacle connector disposed in the second end, wherein the female receptacle connector is adapted to removably couple to the drive shaft of the torque tool; a ring mass coupled to the body and having an inner diameter that is larger than an outer diameter of the body; and a first socket having a first socket end adapted to removably couple to the lug, and a second socket end adapted to engage a head of a first fastener having a first head size, wherein at least a portion of the ring mass includes a material that has a density that is greater than the body material density.

15. The system of claim 14, wherein the socket adapter further includes ribs radiating outwardly from the body between the first and second ends and coupling the ring mass to the body.

16. The system of claim 15, wherein the socket adapter further includes a corresponding opening disposed between each pair of adjacent ribs.

17. The system of claim 15, wherein the body, the ribs, and the ring mass are a monolithic structure.

18. The system of claim 14, wherein the torque power tool is an impact driver or a pulse tool, and includes a hammer and an anvil, wherein the drive shaft includes the anvil and receives torque from the hammer.

* * * * *